US007144053B2

(12) United States Patent
Bashford

(10) Patent No.: US 7,144,053 B2
(45) Date of Patent: Dec. 5, 2006

(54) ELECTRIC STRIKE ASSEMBLY

(75) Inventor: Anthony J. Bashford, Baden (CA)

(73) Assignee: Rutherford Controls Int'l Corp., Cambridge (CA)

( * ) Notice: Subject to any disclaimer, the term of this patent is extended or adjusted under 35 U.S.C. 154(b) by 0 days.

(21) Appl. No.: 10/988,578

(22) Filed: Nov. 16, 2004

(65) Prior Publication Data

US 2005/0099024 A1 May 12, 2005

Related U.S. Application Data

(63) Continuation of application No. 10/259,394, filed on Sep. 30, 2002, now Pat. No. 6,874,830.

(51) Int. Cl.
*E05B 15/02* (2006.01)

(52) U.S. Cl. ..... 292/341.16; 292/201; 292/216; 292/244; 292/341.15; 292/341.18; 292/DIG. 60; 292/DIG. 65

(58) Field of Classification Search ..... 292/341.16, 292/201, 216, 244, 341.15, 341.18, DIG. 60, 292/DIG. 65
See application file for complete search history.

(56) References Cited

U.S. PATENT DOCUMENTS 381,725 A * 4/1888 Schneider ..... 292/341.16
419,766 A * 1/1890 Glaeser ..... 292/341.16
526,909 A * 10/1894 Pratt ..... 292/341.16
3,179,458 A 4/1965 Sconzo
3,211,850 A * 10/1965 Toepfer ..... 200/61.64
3,325,203 A * 6/1967 Moler ..... 292/201
3,640,560 A * 2/1972 Zawadzki et al. ..... 292/341.16
3,908,226 A 9/1975 Read et al.
3,910,617 A * 10/1975 Scalza et al. ..... 292/341.16
4,056,277 A * 11/1977 Gamus et al. ..... 292/341.16
4,429,556 A * 2/1984 Kambic ..... 70/149
4,471,983 A * 9/1984 Bischoff et al. ..... 292/341.16
4,529,234 A * 7/1985 Senften ..... 292/169.15
4,579,376 A * 4/1986 Charlton ..... 292/144
4,593,543 A * 6/1986 Stefanek ..... 70/134
4,685,709 A * 8/1987 Kambic ..... 292/201
4,756,566 A * 7/1988 Logas ..... 292/341.16
4,867,496 A * 9/1989 Thomas ..... 292/341.16
4,900,074 A * 2/1990 Kleefeldt et al. ..... 292/216
4,917,425 A * 4/1990 Logas ..... 292/341.16
4,984,835 A * 1/1991 Vadacchino et al. ... 292/341.16
4,986,584 A * 1/1991 Logas ..... 292/341.16
5,076,625 A 12/1991 Oxley
5,092,638 A * 3/1992 Mizuki ..... 292/216
5,127,691 A * 7/1992 Herron et al. ..... 292/341.16
5,186,504 A 2/1993 Takaishi et al.
5,219,196 A 6/1993 Luker
D337,715 S 7/1993 Rutherford
5,246,258 A 9/1993 Kerschenbaum et al.
5,484,180 A * 1/1996 Helmar ..... 292/341.16

(Continued)

FOREIGN PATENT DOCUMENTS

EP 1 091 060 A1 4/2001

(Continued)

*Primary Examiner*—Brian E. Glessner
*Assistant Examiner*—Carlos Lugo
(74) *Attorney, Agent, or Firm*—Arent Fox PLLC

(57) ABSTRACT

An electric strike includes a housing and a two-position mode selector for selecting a mode of the electric strike. Specifically, the two-position mode selector is operable from outside the housing, and the two-position mode selector is configured to allow the electric strike to selectively operate in a first mode, such as a fail-secure mode, or a second mode, such as a fail-safe mode.

30 Claims, 18 Drawing Sheets

U.S. PATENT DOCUMENTS 5,490,699 A * 2/1996 Uyeda ..... 292/341.16
5,511,839 A 4/1996 Fuss et al.
5,735,559 A * 4/1998 Frolov ..... 292/341.16
5,788,295 A * 8/1998 Fuss et al. ..... 292/341.16
5,890,385 A * 4/1999 Lee ..... 70/472
5,924,750 A * 7/1999 Fuss et al. ..... 292/201
5,934,720 A * 8/1999 Karalius ..... 292/341.16
5,988,711 A * 11/1999 Toma ..... 292/341.16
6,003,910 A 12/1999 Dupont et al.
6,021,038 A * 2/2000 Hanchett, Jr. ..... 361/156
6,076,870 A * 6/2000 Frolov ..... 292/341.16
6,082,791 A * 7/2000 Frolov et al. ..... 292/341.16
6,199,923 B1 * 3/2001 Rice et al. ..... 292/216
6,299,225 B1 * 10/2001 Chang ..... 292/341.16
6,325,429 B1 * 12/2001 Oxley ..... 292/341.16
6,595,563 B1 * 7/2003 Kiernan ..... 292/341.16
6,634,685 B1 * 10/2003 Herron et al. ..... 292/341.16
6,784,784 B1 * 8/2004 Zehrung ..... 340/5.3

FOREIGN PATENT DOCUMENTS

GB 352481 7/1931
GB 2 280 218 A 1/1995
WO 86/02690 5/1986

* cited by examiner

ELECTRIC STRIKE ASSEMBLY

This is a Continuation of application Ser. No. 10/259,394 filed Sep. 30, 2002, now U.S. Pat. No. 6,874,830.

BACKGROUND OF THE INVENTION

1. Field of the Invention

This invention relates to door locking mechanisms, more particularly to electric door locking mechanisms commonly known as electric strikes.

Electric strikes, also known as electric door openers, electric releases and electric release strikes, are used to control access to buildings or areas. An actuation means (e.g. an electrically driven motor or solenoid) is used to either block or release a rotatable keeper to either prevent or allow release of a door's latch bolt, to lock the door or allow it to be opened.

Typically, electric strikes have two modes, namely a "fail-secure" mode (where the door is locked with the power removed, i.e. the actuation means must be triggered to allow the door to be opened), and a "fail-safe" mode (where the door is unlocked with the power removed, i.e. the actuation means must be triggered to prevent the door from being opened). Some strikes on the market have only one-mode capability, i.e. they are either fail-secure or fail-safe, while others are dual mode, i.e. the installer can select which mode is desired at the time of installation.

2. Description of the Prior Art

One known dual-mode electric strike, for example, available as GEM model GK-300 and ROFO 2400 series models, has a solenoid mounted on a holder, which is movable within the strike housing. A blocking element is directly attached to the plunger of the solenoid, to block movement of the keeper when the strike is in its locked position. A first screw, reachable from outside the housing, cooperates with a slot in the housing, to define the path along which the holder is movable. When the first screw is tightened, it fastens the holder to the housing, i.e. the holder cannot move. First and second holes are arranged on the housing, to alternately align with a second screw, also reachable from outside the housing, so that at each end position along the holder path of movement, one of a threaded third or fourth hole, both arranged on the holder, is aligned with either the first hole or the second hole, and the second screw can be inserted into the appropriate first or second hole and screwed into the visible third or fourth hole. The installer can configure the GEM strike in either the fail-safe or fail-secure mode by selecting which holes are used. However, doing so is a tedious and tricky process, requiring proper alignment of holes, careful removal and replacement of one screw, and careful loosening (without removal) of another screw.

There is a need for an electric strike which is more readily switchable between fail-secure and fail-safe modes, and which preferably offers other advantages over prior art strikes.

SUMMARY OF THE INVENTION

In view of the preceding, it is an object of the invention to provide an improved electric strike, which among other features, provides rapid and easy selection between fail-safe and fail-secure modes.

In the invention, a keeper is pivotably arranged in a housing. When prevented from pivoting from its home position, the keeper blocks movement of a latch bolt extending from a door, so that the door is locked. When the keeper is allowed to pivot, the latch bolt can push the keeper aside, so that the door can be opened. To prevent the keeper from pivoting, the keeper has at least one abutment, which a blocking surface or surfaces of a blocking element either contacts (door locked) or does not contact (door unlocked) when the keeper tries to pivot. The blocking element is movable by an actuation means, for example a solenoid, between a first (unenergized) position and a second (energized) position. The blocking element and blocking element actuation means are mounted in a holder, which in turn is slidably mounted in a housing, for movement between one of two holder positions, namely a fail-secure position and a fail-safe position. In the fail-secure position, the blocking surfaces are opposite the keeper's abutments in the unenergized position, and in the fail-safe position the blocking surfaces are opposite the keeper's abutments only when the actuator is energized. A two-position mode selector, set at the time of installation, establishes which of the two holder positions is used, i.e. whether the strike is installed in fail-safe or fail-secure mode. In the preferred embodiment, the mode selector is an eccentric, rotatable between two positions 180 degrees apart, accessible from outside the housing.

The strike preferably also has a latch bolt monitor arm pivotally mounted in the housing. When the latch bolt is in place in the strike, i.e. when the door is closed, the latch bolt depresses a plate which rotates the latch bolt monitor arm, bringing a cam into contact with the switch button of a microswitch, thereby indicating whether the door is open or closed.

The strike preferably also has a keeper microswitch arranged in the housing and cooperating with an indicator cutout arranged on the keeper to indicate when the keeper is either in its home position, or its rotated position, indicating opening of the door. The keeper microswitch is actuated when the keeper is in one position, and not actuated in the other keeper position, by a surface of the keeper depressing or not depressing the switch button of the keeper microswitch.

The strike assembly includes a lip bracket attached to the housing, to allow on-site dimensional adjustment. The lip bracket preferably has profiled surfaces cooperating with similarly profiled surfaces on the housing, to provide stepwise adjustment of the relative position of the lip bracket to the housing together with positive locking of the lip bracket to the housing when the lip bracket is secured to the housing. In the preferred embodiment, a particular saw-tooth engagement is used, as will be described in detail below.

As an anti-intrusion feature in the preferred embodiment, to prevent someone from inserting something to attempt to dislodge the blocking element and thereby open the door, the keeper is profiled so as to provide little or no clearance between it and the housing, and furthermore a lip is provided in the housing to catch anything inserted and the keeper is shaped to direct anything inserted to the area of that lip.

Further features of the invention will be described or will become apparent in the course of the following detailed description.

BRIEF DESCRIPTION OF THE DRAWINGS

In order that the invention may be more clearly understood, the preferred embodiment thereof will now be described in detail, as an example, with reference to the accompanying drawings, in which:

FIGS. 33A and 34B are side and rear views respectively, corresponding to FIGS. 32A and 32B, shown in fail-secure mode.

DETAILED DESCRIPTION

Figure 1:
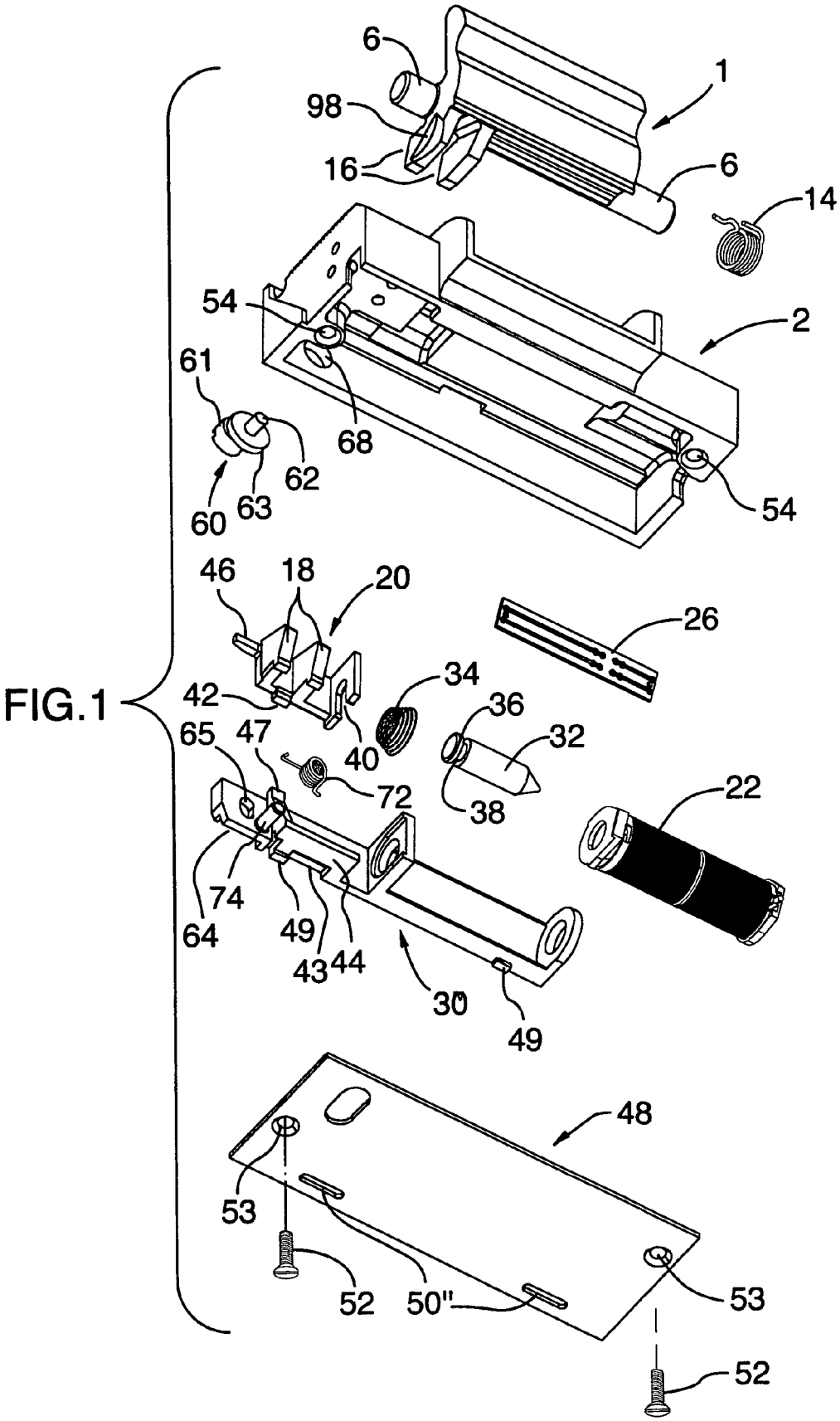
FIG. 1 is an exploded perspective rear view of a strike according to the preferred embodiment.
Figure 2:
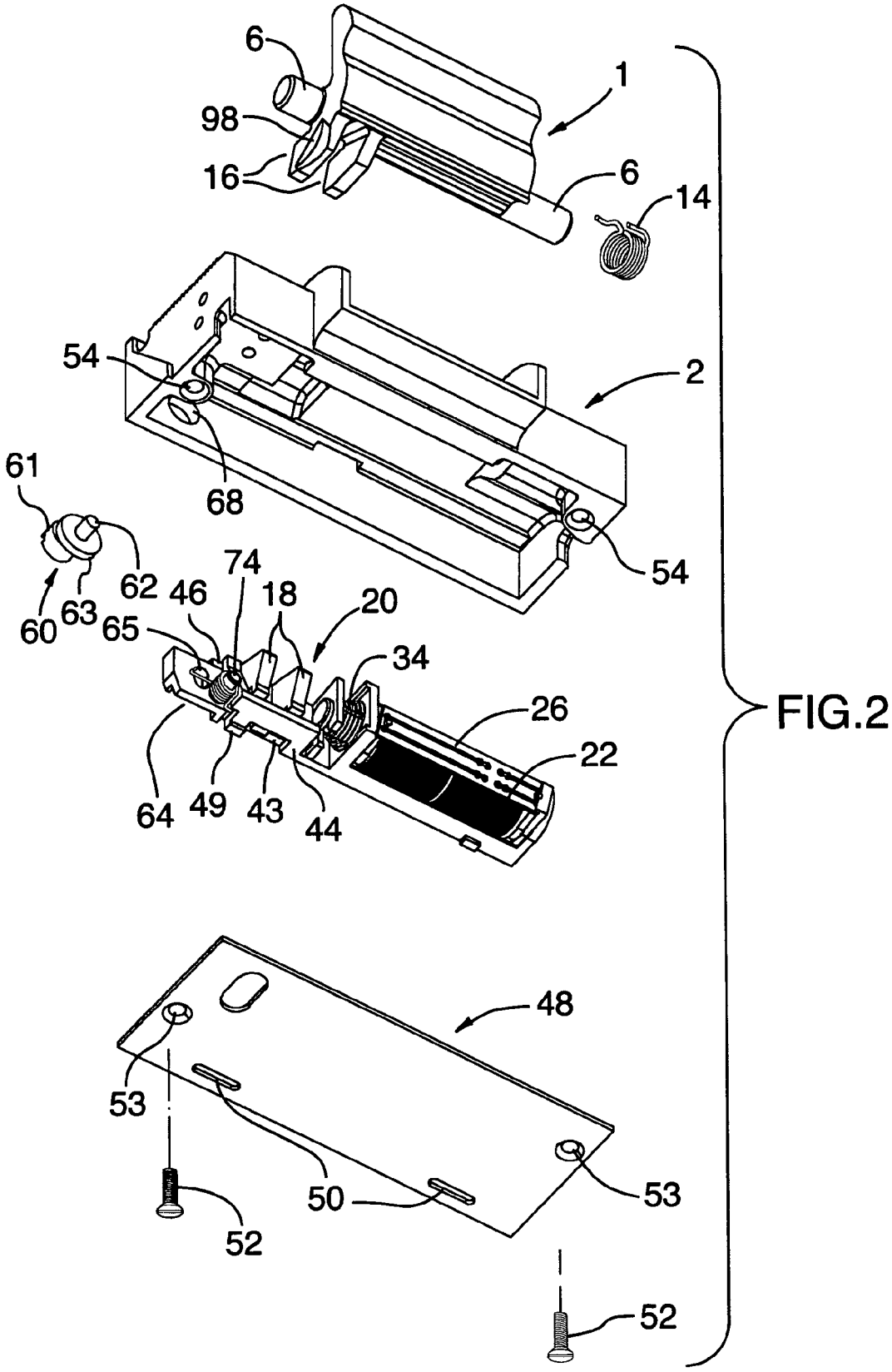
FIG. 2 is a partly assembled view corresponding to FIG. 1, where the blocking element, solenoid and holder have been assembled.
Figure 3:
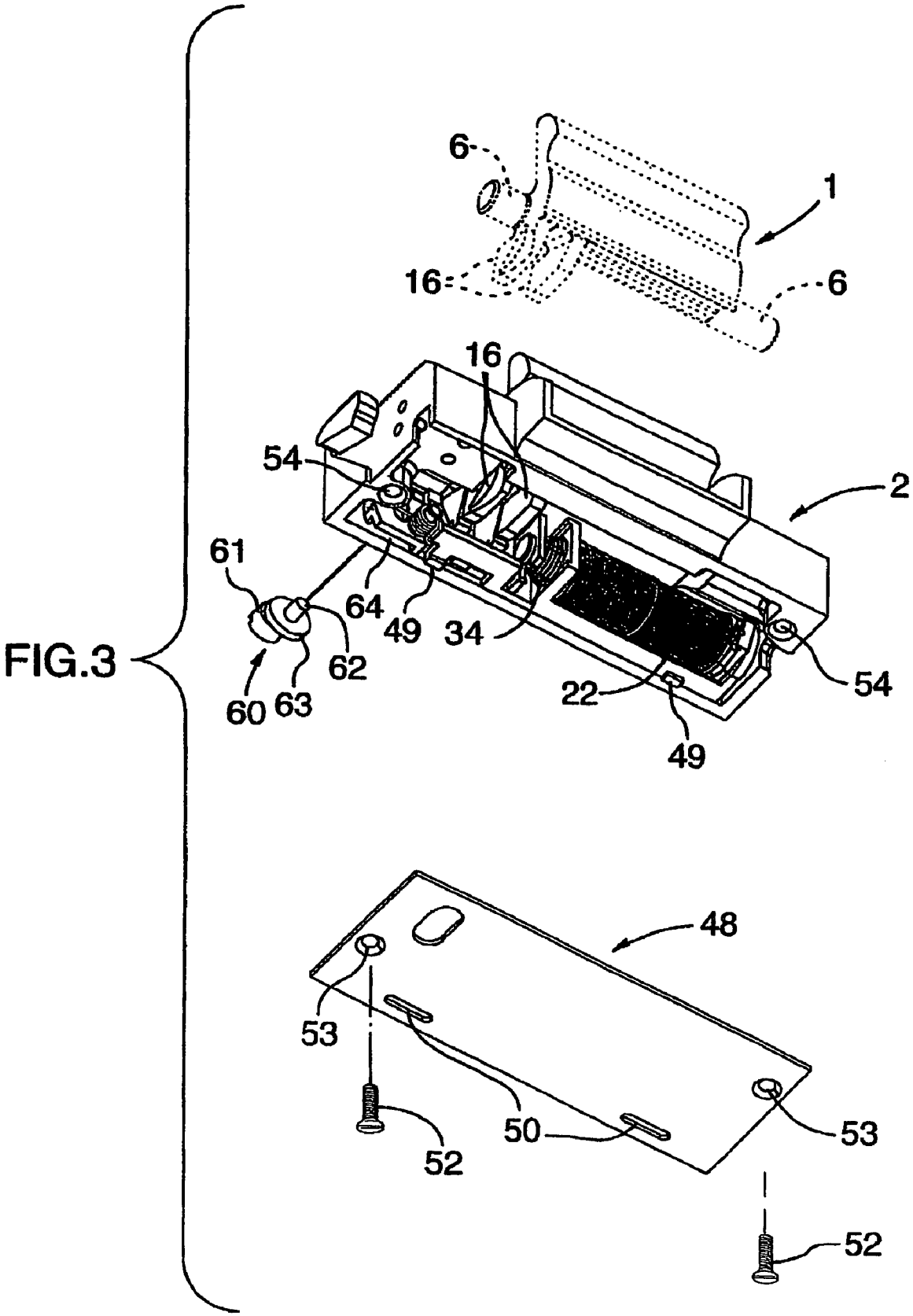
FIG. 3 is a further assembled view corresponding to FIGS. 1 and 2, where the blocking element, solenoid, holder and keeper have been assembled into the housing.
Figure 4:
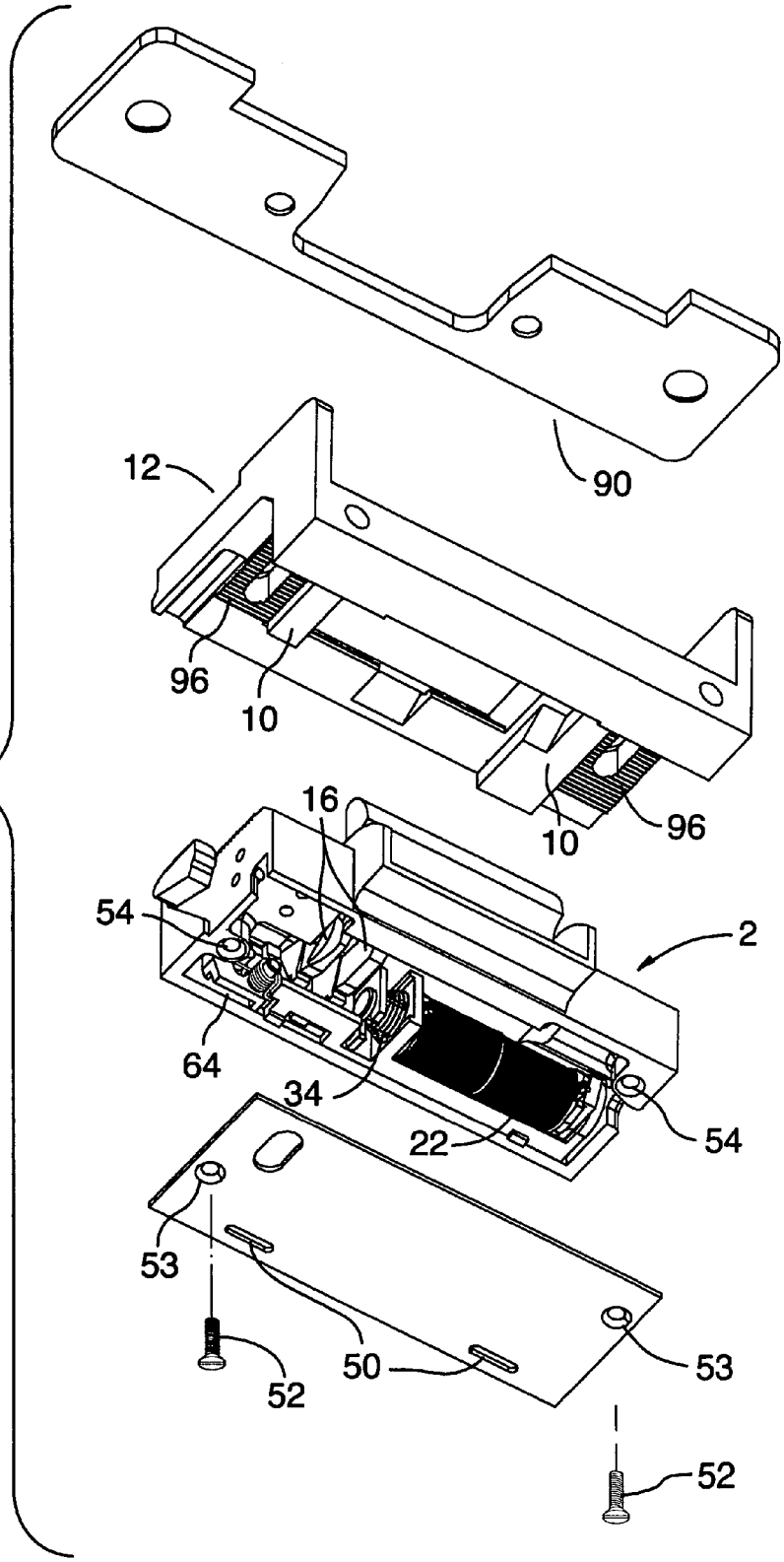
FIG. 4 is a view corresponding to FIG. 3, but also showing a lip bracket and a face plate.
Figure 5:
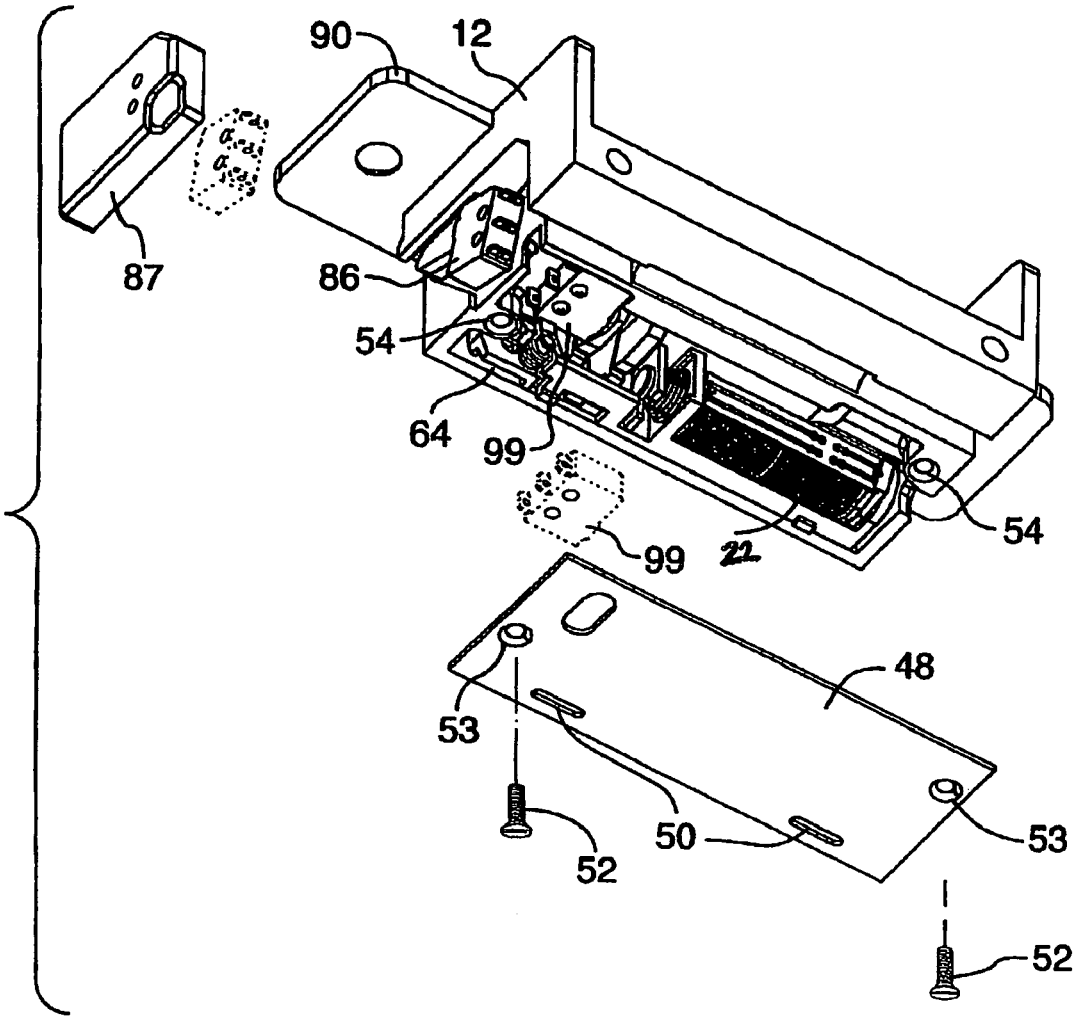
FIG. 5 is a view corresponding to FIG. 4, showing the housing assembly assembled with the lip bracket.
Figure 6:
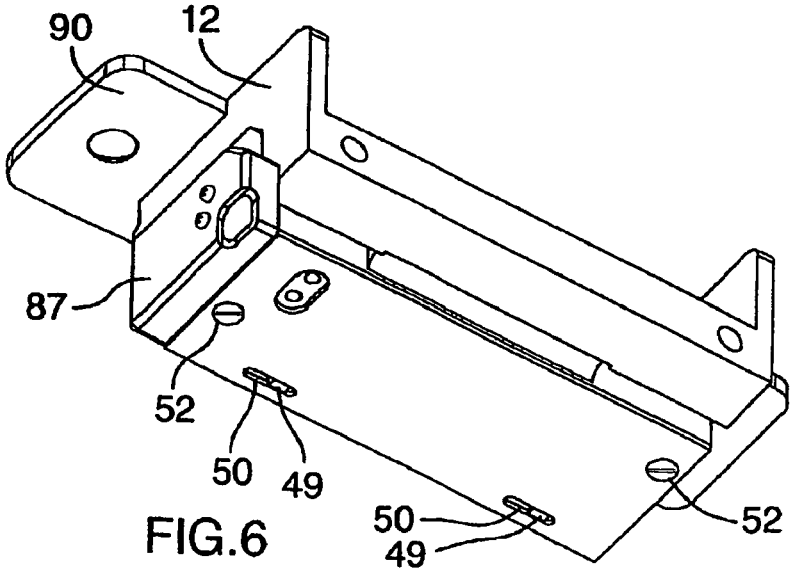
FIG. 6 is a view corresponding to FIG. 5, showing the completed assembly.
Figure 7:
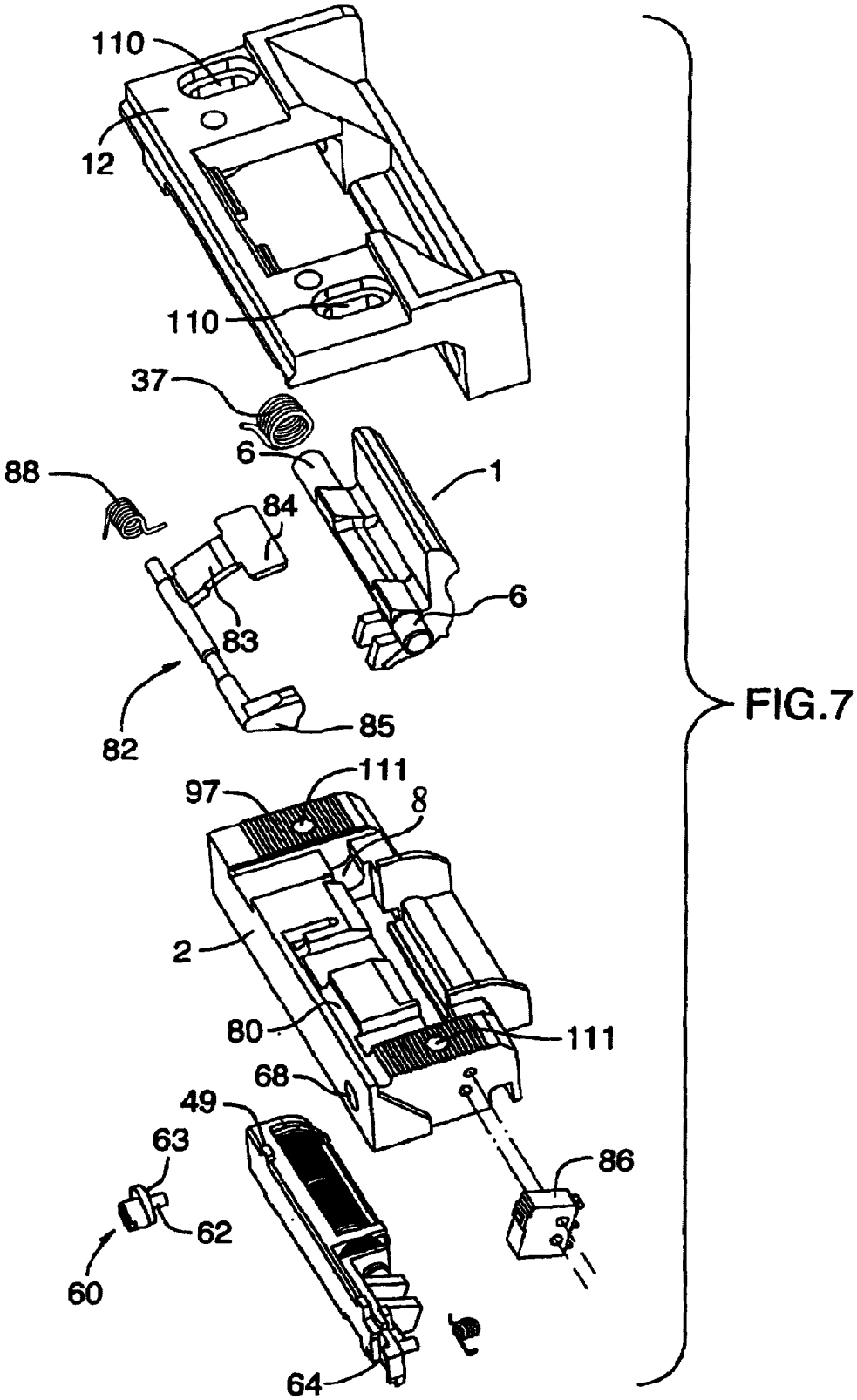
FIG. 7 is an exploded perspective view similar to FIG. 1, but viewing the front of the preferred embodiment.
Figure 9:
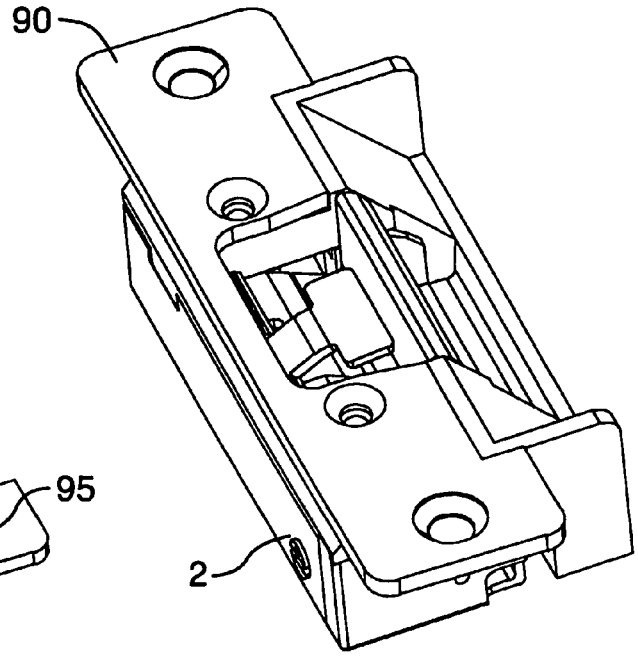
FIG. 9 is a view corresponding to FIG. 8, fully assembled.
Figure 8:
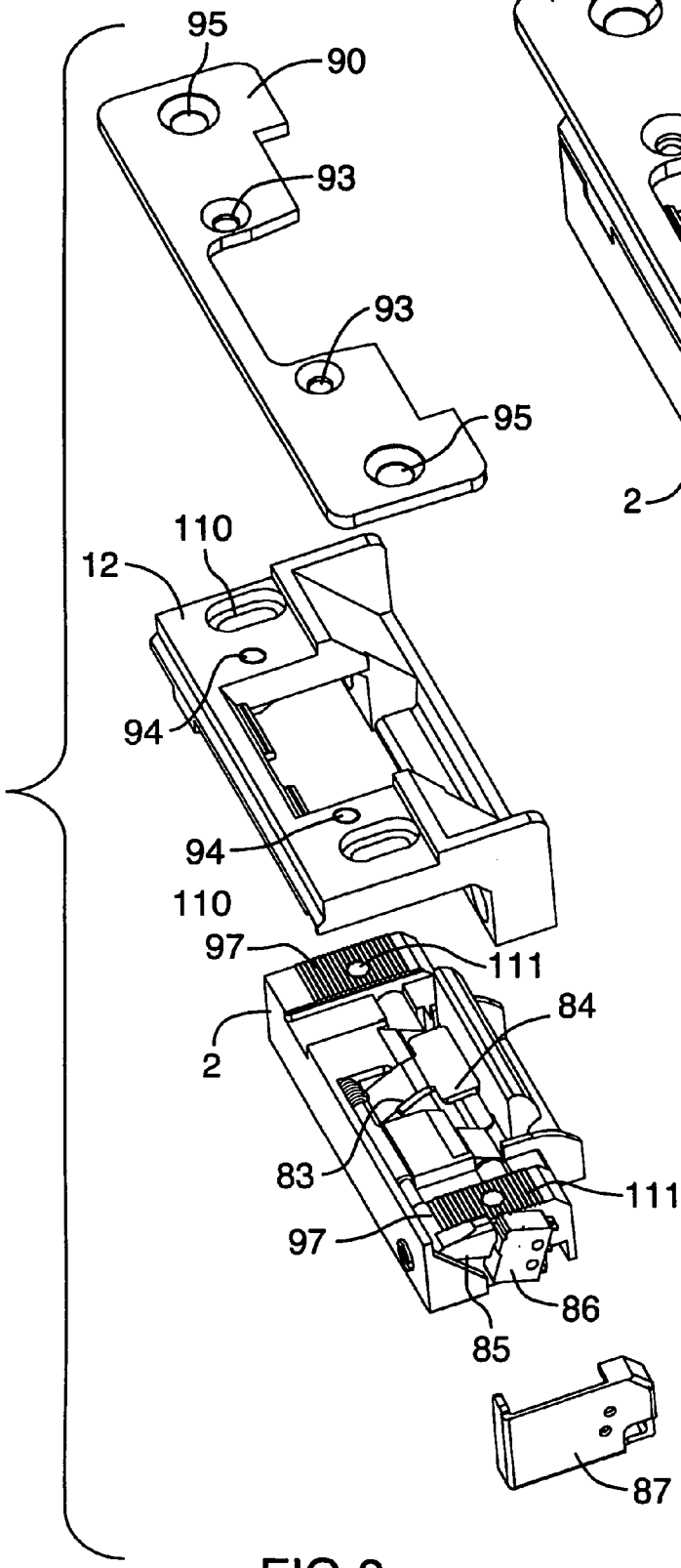
FIG. 8 is a view corresponding to FIG. 7, further assembled.

FIGS. 1–6 show a progressive build of the strike as seen from the rear; FIGS. 7–9 are similar, but from the front.

In the preferred embodiment of the invention, a keeper 1 is pivotably arranged in a housing 2, and is pivotable between a rotated position where the latch bolt 3 of a door 4 can be removed from the strike to open the door, and a home position (best seen in FIG. 23A) where the keeper, if prevented from moving, blocks removal of the latch bolt and thus keeps the door locked. When the keeper is allowed to pivot, the latch bolt can push the keeper aside, so that the door can be opened. The keeper pivots on two trunnions 6 at opposite ends thereof, which fit into slots 8 in the housing (see FIG. 7) and which are trapped there by surfaces 10 on a lip bracket 12 (see FIG. 4). The keeper is biased towards its home position by a suitable biasing means such as a corrosion-resistant torsion spring 14.

Figure 29:
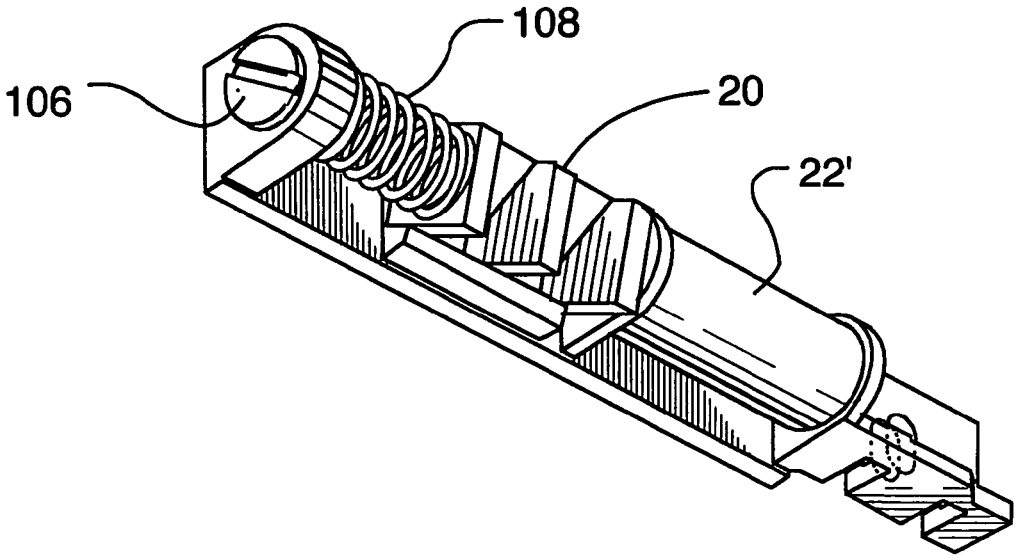
FIG. 29 is a perspective view of an alternative embodiment, illustrating a push-type solenoid instead of a pull-type solenoid.
Figure 30A:
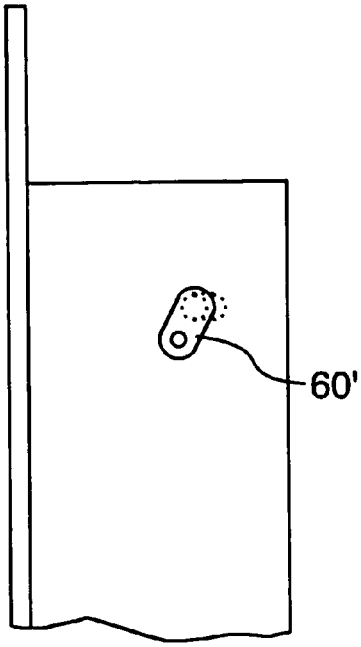
FIGS. 30A and 30B are side and rear views respectively, showing an alternative mode selector using a two-position lever, shown in fail-safe mode.
Figure 30B:
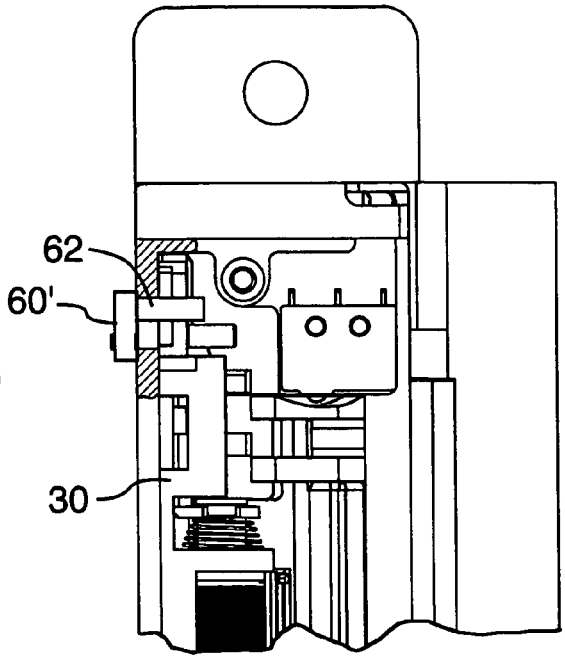
Figure 31A:
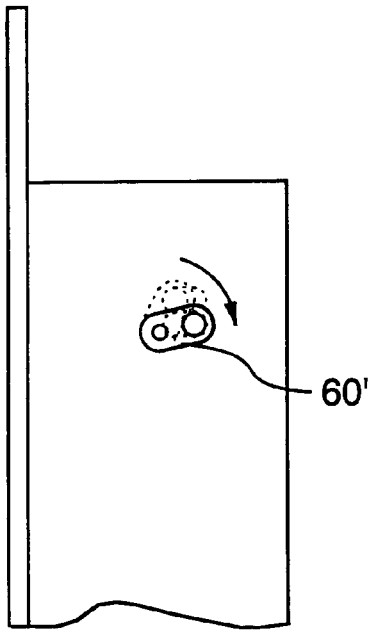
FIGS. 31A and 31B are side and rear views respectively, corresponding to FIGS. 30A and 30B, shown in fail-secure mode.
Figure 31B:
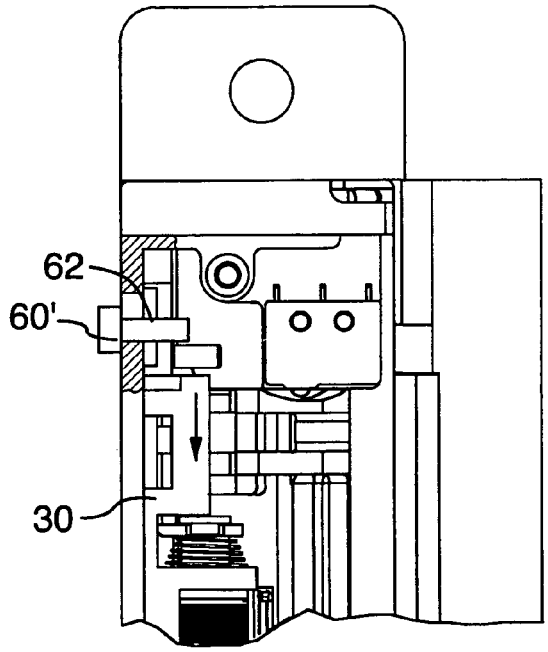
Figure 32A:
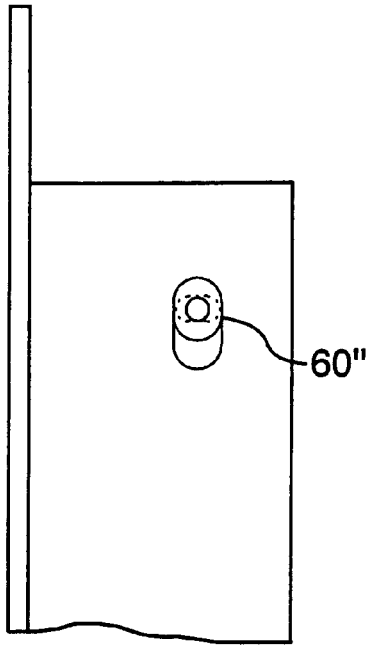
FIGS. 32A and 32B are side and rear views respectively, showing another alternative mode selector using a two-position slide or button, shown in fail-safe mode.
Figure 32B:
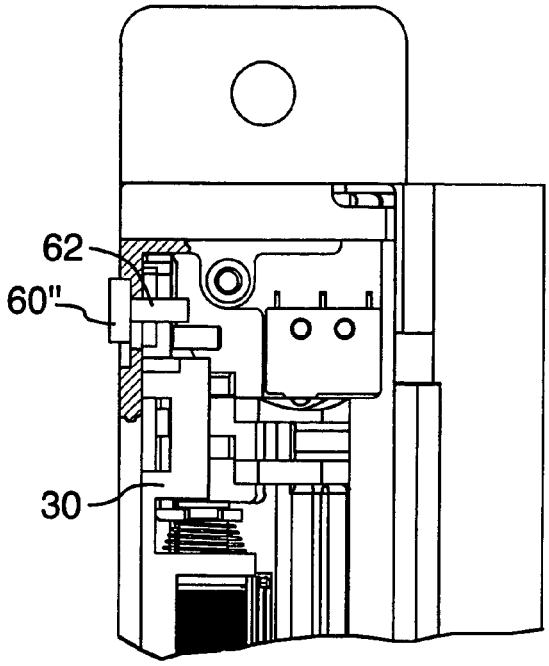
Figure 33A:
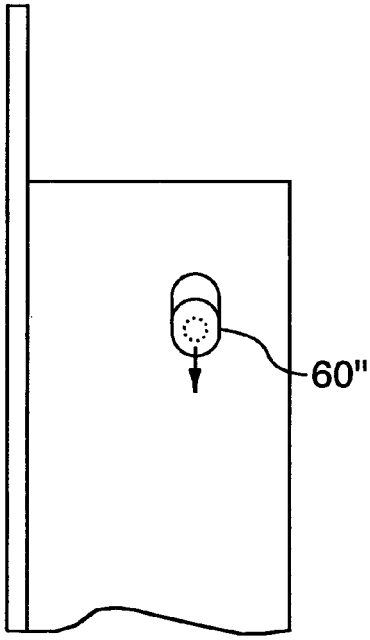
Figure 33B:
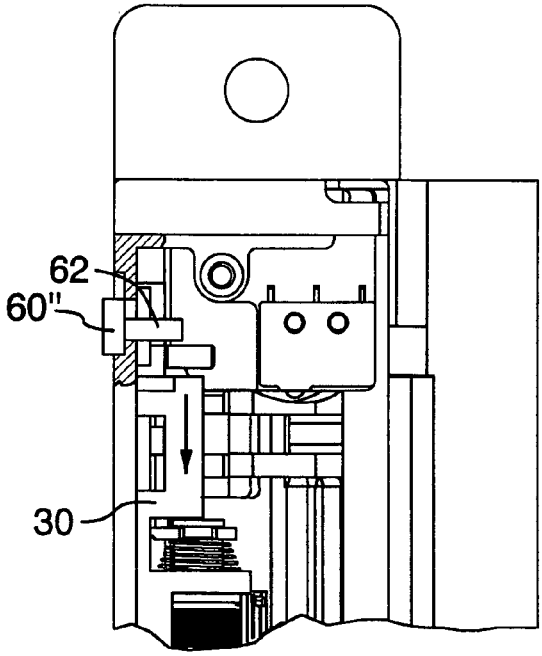

For the door to be locked, i.e. for the keeper to be prevented from pivoting, the keeper has at least one and preferably several abutments 16, which blocking surfaces 18 of a blocking element 20 either oppose (door locked) or do not oppose (door unlocked) when the keeper tries to pivot. In the preferred embodiment, there are two blocking surfaces 18, but obviously there could be only one, or there could be more than two, subject to obvious space constraints. The blocking element is movable by an actuation means, for example a solenoid 22, between a first (unenergized) position and a second (energized) position. In the preferred embodiment, the solenoid is a "pull" type solenoid, although a "push" type can be used instead, as described later below and as illustrated in FIG. 29. The solenoid has electric feeding wires (not shown) routed inside the housing and to external terminals 26. Preferably but not necessarily, the solenoid is dual wound and has four wires, to provide flexibility through an option to connect for either 12 or 24 volts DC or AC. For illustration purposes, the solenoid is shown without its typical insulating cover.

The blocking element 20 and solenoid 22 are mounted in a holder 30. The solenoid pulls a plunger 32, against the biasing force of a spring 34, which preferably is made of stainless steel for corrosion resistance. The plunger has a disc portion 36 on the distal end thereof, and a relief area 38 which fits into a slot 40 in a plate at the end of the blocking element. This ties the blocking element to the movement of the plunger, so that when the solenoid is actuated, the blocking element is pulled towards the solenoid, thus moving the blocking surfaces 18 either into or out of engagement with the abutments 16 of the keeper, depending on which mode was selected at the time of installation. In the fail-secure mode actuation of the solenoid moves the blocking surfaces out of engagement (i.e. they normally do block in a power-off mode, so the door is locked), whereas in the fail-safe mode actuation of the solenoid moves the blocking surfaces into engagement (i.e. they normally do not block in a power-off mode, so the door is unlocked).

The blocking element is guided at one end by the solenoid plunger 32, and at the other end on the rear side by a tab 42 in a slot 43 under a guide rail 44, and on the front side by a projection 46, which extends under a guide 47 on the holder.

The holder 30, in which the blocking element 20 and solenoid 22 are mounted, in turn is slidably mounted in the housing 2, for movement between one of two holder positions, namely a fail-secure position and a fail-safe position. The holder is held in place front to back by being trapped between the housing and a rear plate 48, and has alignment protrusions 49 which cooperate with alignment slots 50 arranged in the rear plate and in the housing. The rear plate is secured to the housing by screws 52 through holes 53 in the rear plate into holes 54 in the housing.

In the fail-secure position, the blocking surfaces 18 are opposite the keeper's abutments 16 in the unenergized position, and in the fail-safe position the blocking surfaces are opposite the keeper's abutments only when the actuator is energized. A two-position mode selector, for example an eccentric 60, establishes which of the two holder positions is used, i.e. whether the strike is installed in fail-safe or fail-secure mode. The mode is set by the installer at the time of installation.

In the preferred embodiment, the mode selector 60 is rotatable via a slotted head 61 between two positions 180 degrees apart, projecting through a hole 68 in the housing and therefore accessible from outside the housing. The preferred mode selector has an eccentric disc portion 63, and a pin 62 extending centrally therefrom. Rotating the head 180 degrees, using a screwdriver or even a small coin, results in the eccentric disc portion 63 and pin 62 being in one of two spaced-apart positions. Since the disc portion 63 fits into a slot 64 in the back of the holder 30, its displacement by rotation of the selector results in the holder sliding in the housing from one position to another, i.e. from a fail-secure position, to a fail-safe position. The pin 62 fits into a slot 65 in the holder 30, and serves to keep the mode selector in whichever position is selected, by virtue of the spring 72 acting on the pin to keep it biased towards the appropriate end of the slot 65. Preferably the dimensions are arranged so that any load from the holder is borne by the disc portion 63 rather than by the pin 62.

Figure 18:
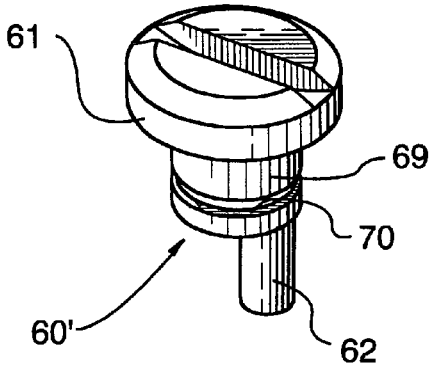
FIG. 18 is a perspective view of an alterative mode selector.
Figure 17:
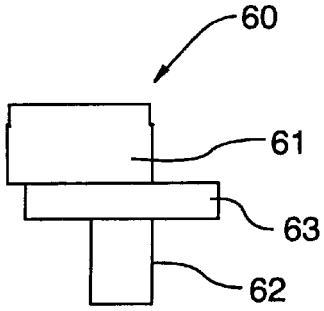
FIG. 17 is an elevation view of the FIG. 16 mode selector.
Figure 19:
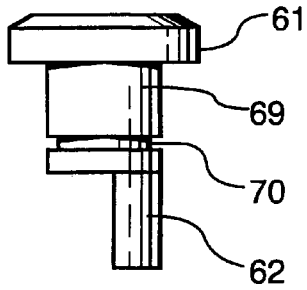
FIG. 19 is an elevation view of the alterative mode selector.
Figure 20:
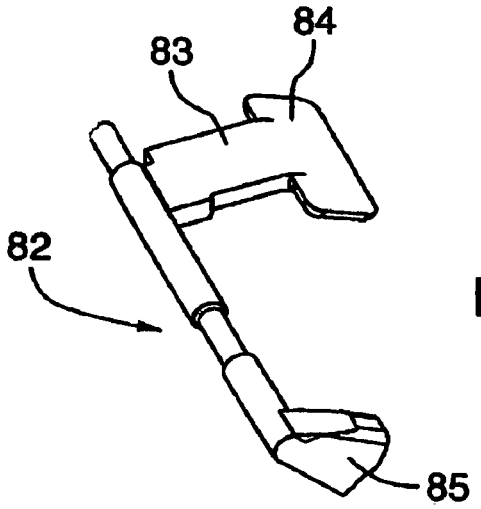
FIG. 20 is a perspective view of a latch monitor arm.
Figure 21:
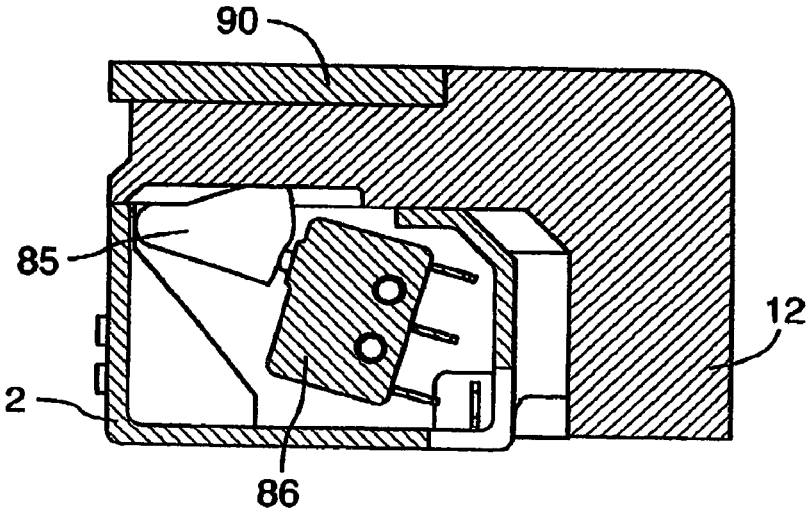
FIG. 21 is a sectional end view showing the latch monitor arm cam when the latch monitor arm is rotated outwardly.
Figure 22:
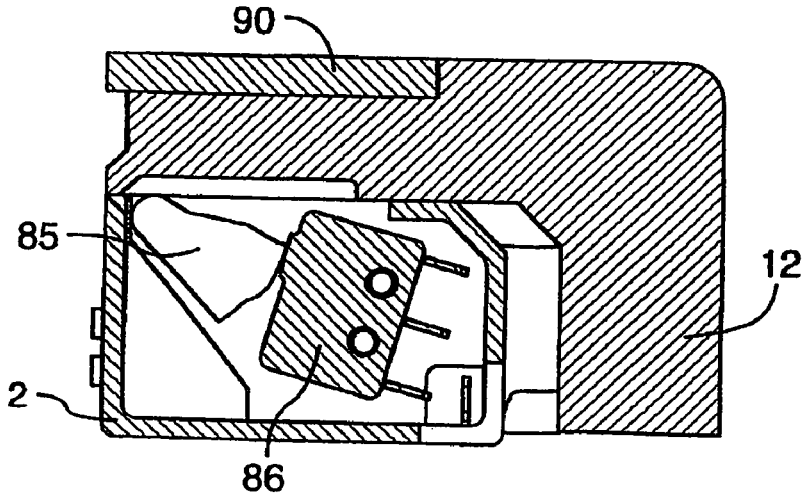
FIG. 22 is a sectional end view showing the latch monitor arm cam when the latch monitor arm is depressed, triggering the latch monitor microswitch.

The preferred embodiment of the mode selector requires installation from inside the housing. In an alternative embodiment, shown in FIGS. 18 and 19, the mode selector 60' has a pin 62 offset from the head, and a cylindrical portion 69. This selector can be inserted through the hole 68 from outside the housing, but requires internal installation of a clip (not shown) in a groove 70 in the cylindrical portion, to prevent it from subsequently falling out. In this alternative embodiment, the pin 62 itself takes any load from the holder.

The two-position mode selector is a key feature of the invention, in that it provides a very simple means for the installer to switch between modes, simply by rotating the selector.

Figure 11:
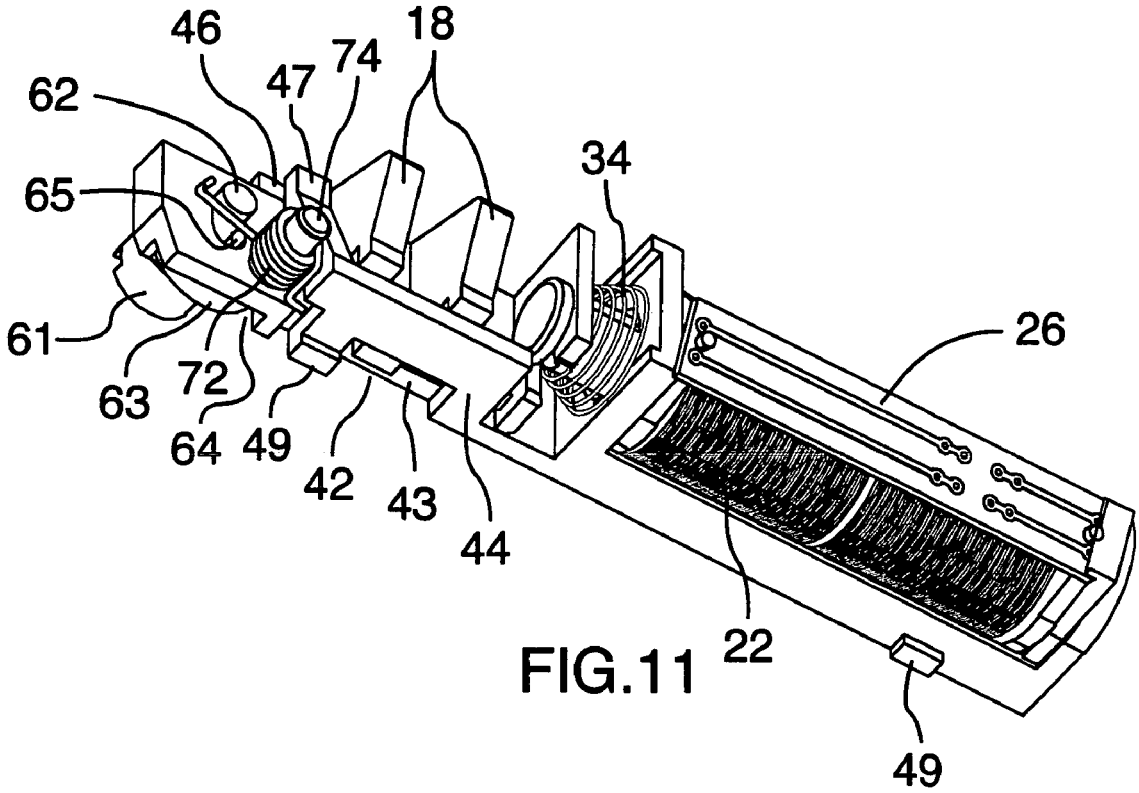
FIG. 11 is a view showing the holder, solenoid, blocking element, mode selector and mode selector biasing spring.
Figure 12:
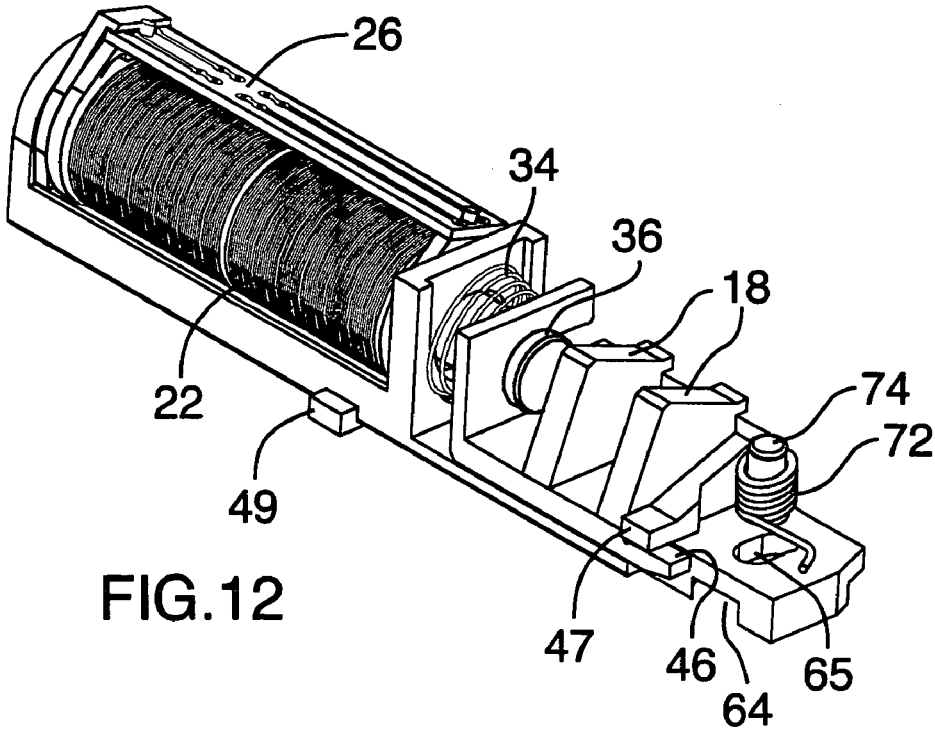
FIG. 12 is a perspective view corresponding to FIG. 11, from a different angle.
Figure 13:
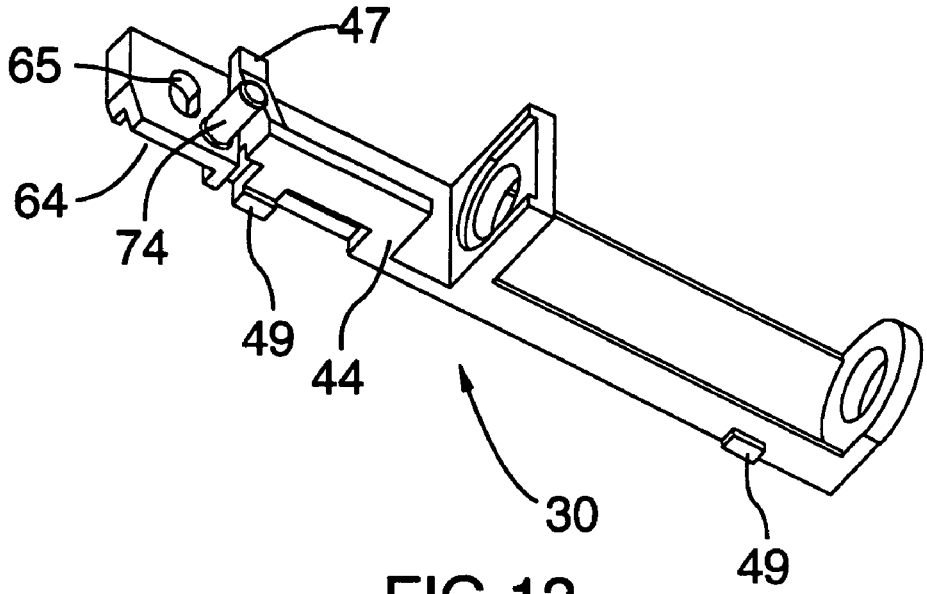
FIG. 13 is a perspective view of just the holder.
Figure 14:
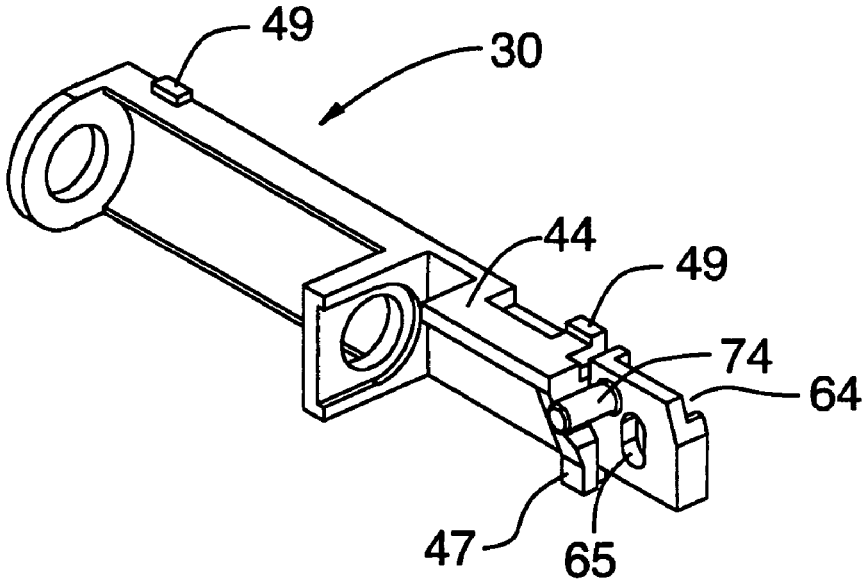
FIG. 14 is a perspective view corresponding to FIG. 13, from a different angle.
Figure 15:
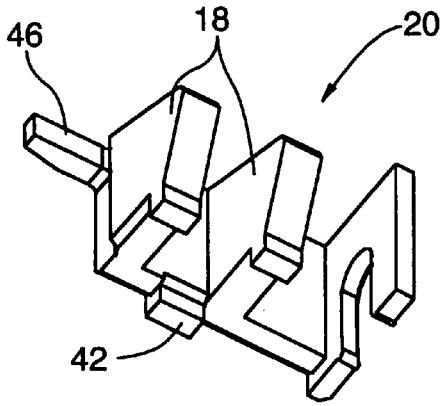
FIG. 15 is a perspective view of the blocking element.
Figure 16:
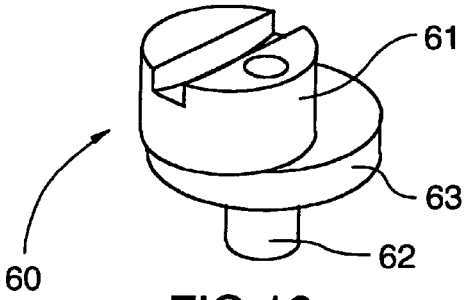
FIG. 16 is a perspective view of a fail-secure vs. fail-safe mode selector.

Once the selector is in the desired position, it of course is highly desirable that it should remain there. Accordingly, in the preferred embodiment, a biasing means is provided so that the selector is biased to remain in whichever one of its two positions is selected. In the preferred embodiment, that biasing means is a spring 72 which is arranged to push the pin towards either end position (in this case by pushing at roughly 90 degrees to a diameter line drawn between the two end points), as seen best in FIGS. 11 and 12. (In FIG. 12, the spring is shown in the position it would be in if the pin 62 was present, though without the pin it in fact would be sprung across the slot, since it pushes the pin away from the position the spring is shown in.) The spring 72 is a torsion spring in the preferred embodiment, mounted on a post 74, but clearly it could be any other suitable arrangement, including for example a leaf spring positioned to act in the same direction.

Referring now to FIGS. 7, 8 and 20–22, the housing further has a groove 80 in its front face for pivotably holding a latch monitor arm 82. The latch monitor arm is generally elongate, having a first end with an extension 83 having a door latch bolt plate 84 at its distal end. At the opposite end of the arm is a microswitch cam 85. When a door latch bolt is present in the strike, it will press the plate inwardly, and hence rotate the latch monitor arm, so that the microswitch cam then triggers a microswitch 86, as, seen in FIGS. 21 and 22 in particular. A cover 87 protects the microswitch. The latch monitor arm 82 is biased outwardly by a latch arm biasing means, for example a torsion spring 88 (see FIG. 7).

Figure 23A:
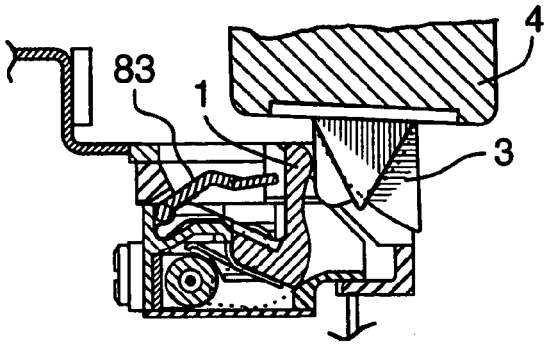
FIGS. 23A–23E show a sequence of latch monitor operation as the door is closed, from the FIG. 23A position where the latch bolt is approaching the strike, to the FIG. 23E position where the latch bolt is fully extended and retained by the keeper.
Figure 23B:
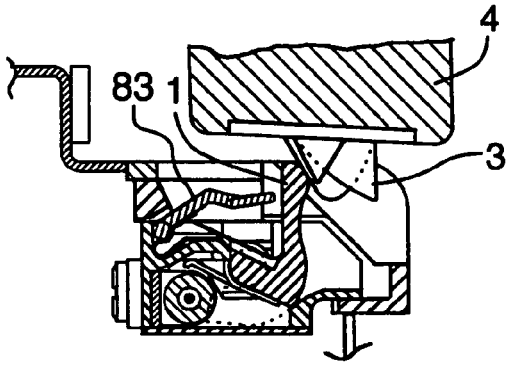
Figure 23C:
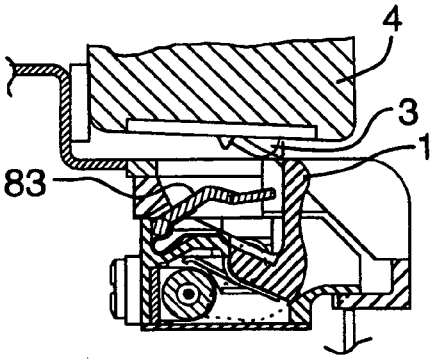
Figure 23D:
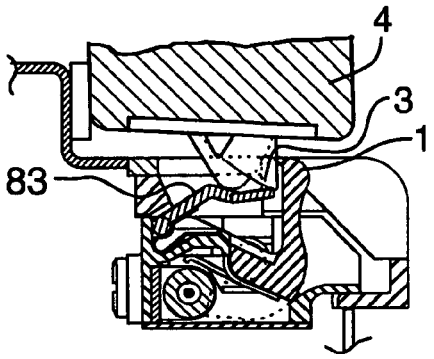
Figure 23E:
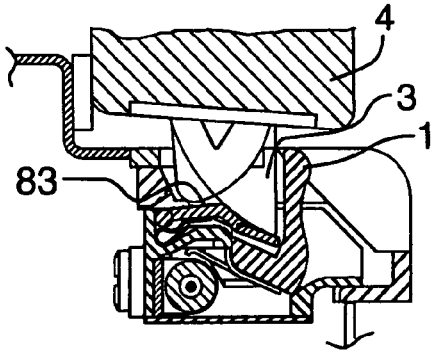

FIGS. 23A–23E show a sequence of latch monitor operation as the door 4 is closed, from the FIG. 23A position where the latch bolt 3 is approaching the strike, to the FIG. 23E position where the latch bolt is fully extended and retained by the keeper. In FIG. 23A, the door latch bolt is still outside the strike and the keeper, and the latch bolt plate 84 is in its raised position. In FIG. 23B, the door latch bolt has contacted the keeper and has begun to retract into the door. FIG. 23C shows full retraction of the door latch bolt into the door, and FIG. 23D shows the door latch bolt just past the keeper and starting to extend again, contacting the latch bolt plate. In FIG. 23E, the door latch bolt has pressed the latch bolt plate to its depressed position, causing the cam 85 to activate the microswitch 86, thus allowing remote monitoring of the door status. Some of the details in these drawings do not correspond to the preferred embodiment, being from an earlier prototype, but the principle is the same.

Figure 10:
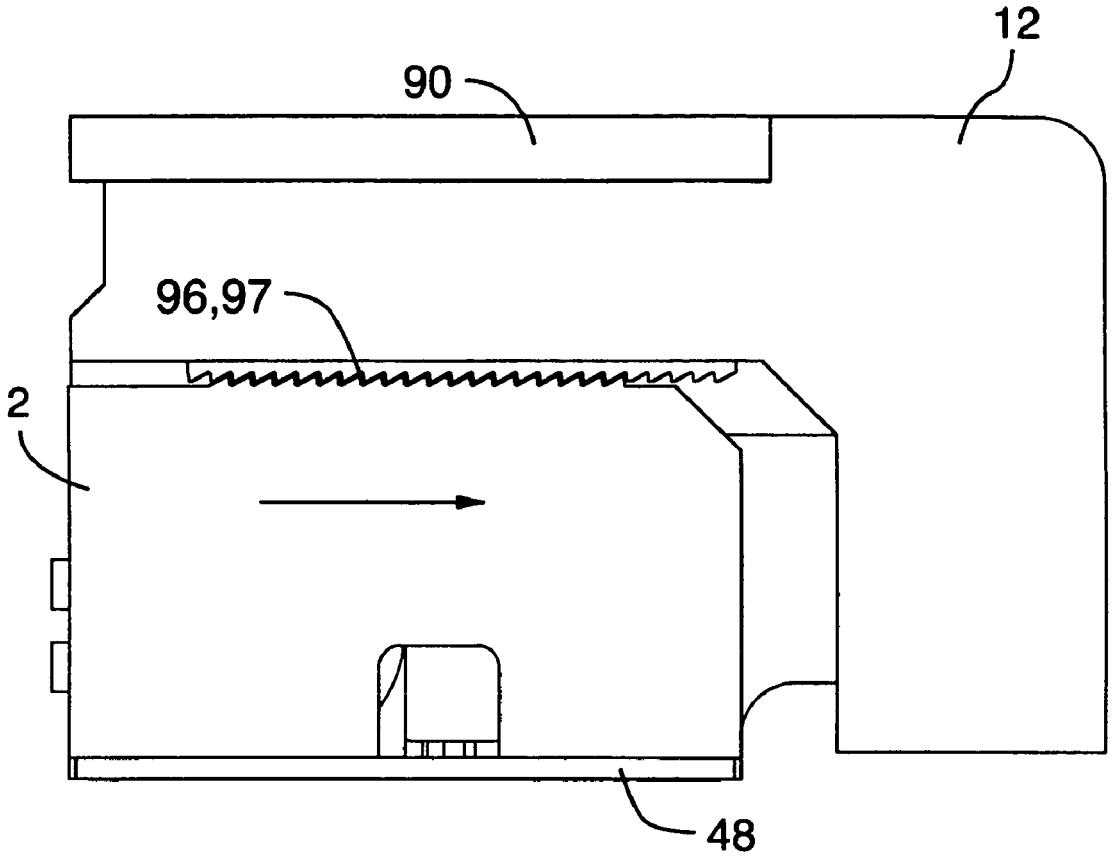
FIG. 10 is a sectioned top view showing the saw-tooth engagement between the housing and lip bracket.

A face plate 90 is secured to the lip bracket 12 by screws (not shown) through holes 93 in the face plate and into holes 94 in the lip bracket, and is used to secure the strike to the door jamb, using screws through mounting holes 95. Face plate configuration can be varied as desired, to suit various new or existing door jamb configurations. The lip bracket preferably has profiled surfaces 96, cooperating with similarly profiled surfaces 97 on the housing, to provide stepwise adjustment coupled with positive locking of the lip bracket to the housing. The lip bracket is secured to the housing at the desired depth setting by screws (not shown) through slots 110 in the lip bracket into holes 111 in the housing. The profiles preferably are as shown in FIG. 10, i.e. complementary saw-tooth surfaces, with the mating surfaces being perpendicular or nearly so in the direction to oppose outward displacement of the housing (as indicated by the arrow) relative to the lip bracket (i.e. in the direction of pull for opening the door). The lip bracket may have several size variations to accommodate either ½ inch or ⅝ inch keepers (or of course any other size which might be adopted).

To positively detect the keeper position in the strike, the keeper 1 advantageously has an indicator cutout 98 arranged to cooperate with a keeper microswitch 99, so that the keeper microswitch is actuated when the keeper is fully retracted, and off at any other position of the keeper. The cutout results in the microswitch not being activated when the keeper is in its home position, but rotation of the keeper brings the ramp out of the cutout into contact with the microswitch, to trigger it. This provides an indication of door opening, for statistical or other purposes.

Figure 24:
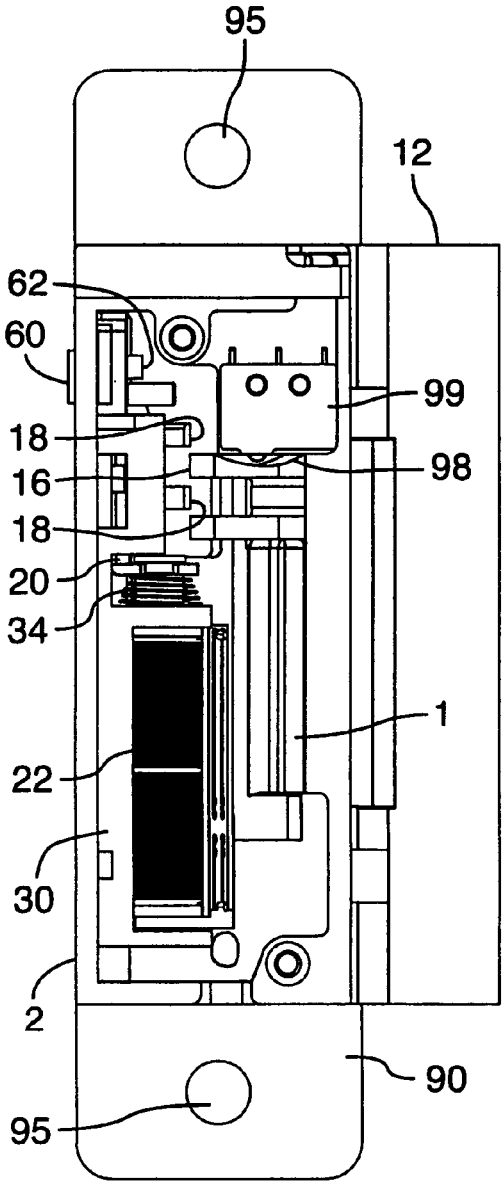
FIG. 24 is a sectioned front view of the strike, in fail-safe mode, with the solenoid unenergized and the blocking element therefore in a position to allow the keeper to rotate.
Figure 25:
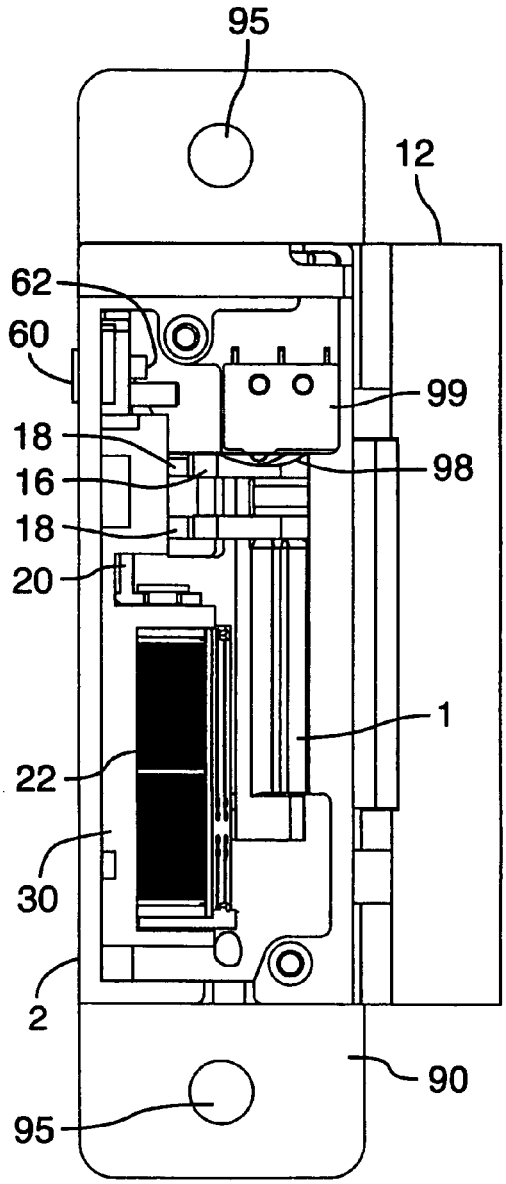
FIG. 25 is a view corresponding to FIG. 24, with the solenoid energized and the blocking element therefore in a position to prevent the keeper from rotating.

FIGS. 24 and 25 show the strike in its fail-safe mode, i.e. the keeper being unblocked when the solenoid is unenergized. FIG. 24 shows the solenoid unenergized, and FIG. 25 shows it energized. It can be seen that in the former position the blocking surfaces 18 are not aligned with the keeper abutments 16 (door free), whereas in the latter position they are (door locked).

Figure 26:
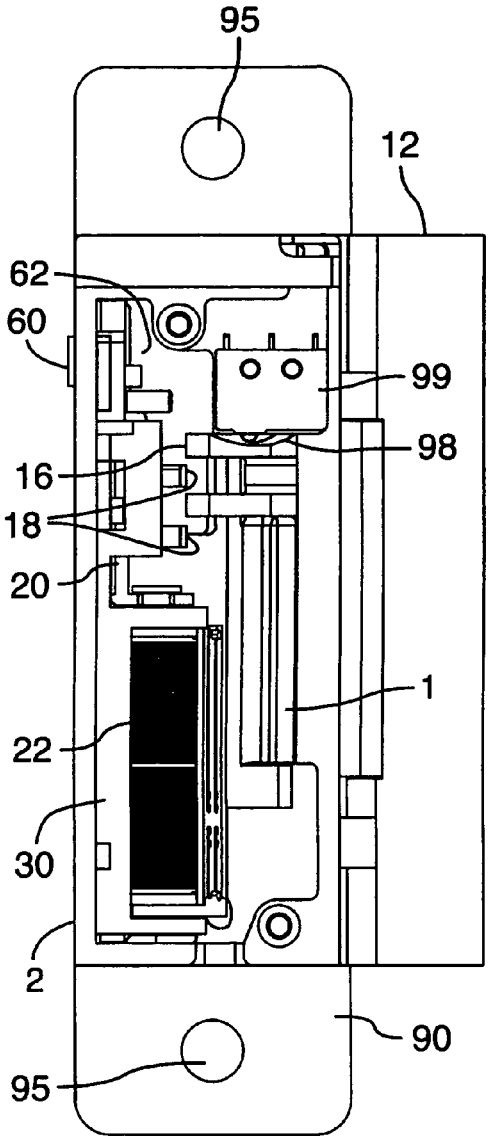
FIG. 26 is a sectioned front view of the strike, in fail-secure mode, with the solenoid energized and the blocking element therefore in a position to allow the keeper to rotate.
Figure 27:
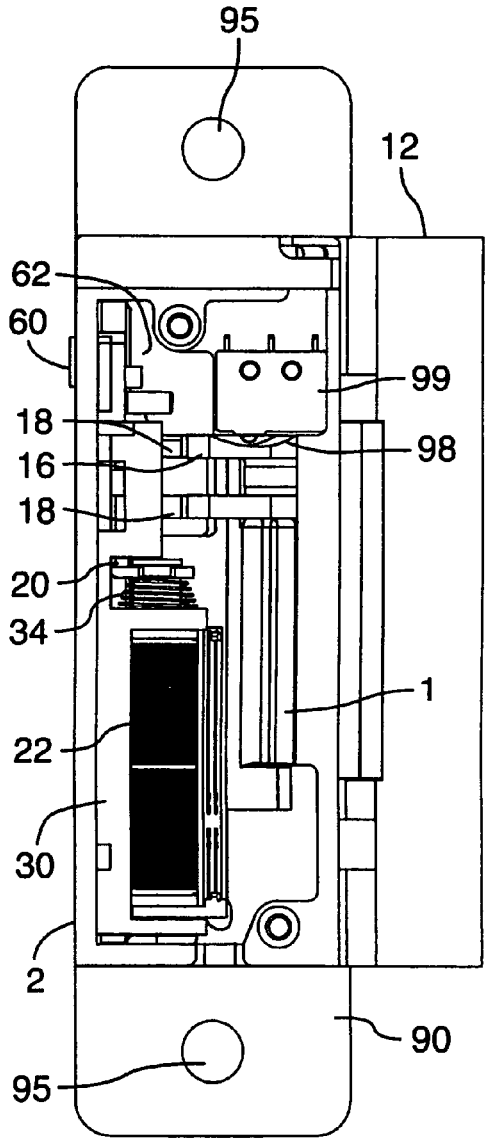
FIG. 27 is a view corresponding to FIG. 26, with the solenoid unenergized and the blocking element therefore in a position to prevent the keeper from rotating.

FIGS. 26 and 27 are similar, but showing the fail-secure mode, with the solenoid energized in FIG. 26 and the door unlocked, and the solenoid unenergized and the door locked in FIG. 27.

Figure 28:
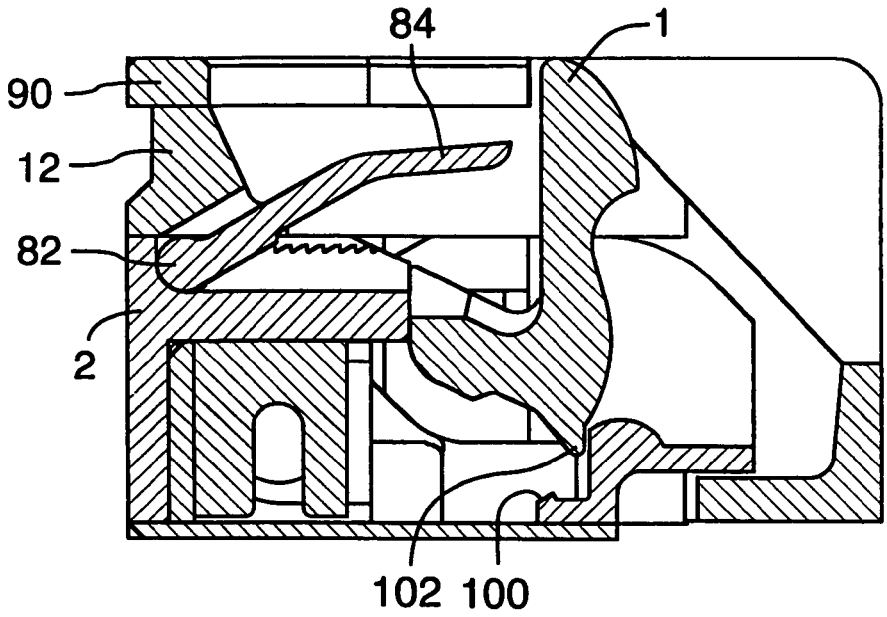
FIG. 28 is a sectioned end view, showing various components previously described and in particular an anti-intrusion profile.

Referring now to FIG. 28, as an anti-intrusion feature in the preferred embodiment, to prevent someone from inserting something thin and flexible to attempt to dislodge the blocking element and thereby open the door, the keeper is profiled so as to provide little or no clearance between it and the housing, and furthermore a catch 100 is provided in the housing to block anything inserted and the keeper has a lip 102 shaped to direct anything inserted to the area of that catch.

It will be appreciated that the above description relates to the preferred embodiment by way of example only. Many variations on the invention will be obvious to those knowledgeable in the field, and such obvious variations are within the scope of the invention as described and claimed, whether or not expressly described.

For example, in addition to possible variations specifically mentioned above, FIG. 29 shows a push-type solenoid 22' instead of the pull-type of the preferred embodiment. The blocking element is guided by a blocking element guide pin 106, and a spring 108 on the guide pin biases the blocking element towards the solenoid.

It should also be appreciated that the two-position mode selector could be configured differently, although the eccentric arrangement is preferred. For example, there could be a small pivotable two-position lever with a pin projecting from it, with the same two end positions as in the preferred embodiment, and a spring arrangement to bias the lever to either of the two positions. Or, there could be a small sliding bar with a pin projecting from it, again with the same two end positions and spring biasing. Or, instead of spring biasing into the end positions, there could be notches or ball-spring detents or the like which the movable selector elements would engage. Some further such examples are illustrated in FIGS. 30A–33B, the key being that each mechanism results in the pin 62 moving from one end position to another, thus moving the holder 30 from one mode position to another, the pin or mode selector preferably being biased by any suitable means to then stay in the selected position. In FIGS. 30A–31B, the mode selector 60' is a small lever, pivotable between two positions, with a pin 62 extending into the housing and engaging the holder 30 as in the preferred embodiment. In FIGS. 32A–33B, the mode selector 60" is a small button, slidable between two positions, again with a pin 62 engaging the holder 30.

Some additional features or advantages are as follows:

a. The strike lends itself equally well to left or right hand jamb installation.
b. Since the pivotal keeper is trunnion mounted, a separate hinge shaft is not required.
c. The keeper position is laterally adjustable for physical installation variables, using the lateral adjustment possibility of the housing relative to the lip bracket.
d. The strike has a compact design. The total thickness is typically 1 3/16" for a 5/8" keeper (3/4" maximum latch projection), and 1 1/16" for a 1/2" keeper (5/8" maximum latch projection).

The choice of materials is not part of the invention per se. However, the keeper is preferably ferrous metal injection molded, investment cast or bar extruded, and provided with a suitable coating to provide a corrosion-resistant keeper. The holder is advantageously metal injection molded or investment cast and suitably surface treated for corrosion resistance. The housing is preferably investment cast or die cast and/or powder metal formed, and suitably plated to provide a corrosion-resistant housing. The blocking element is preferably made of stainless steel to provide a non-magnetic material, and is advantageously surface treated, e.g. plated, for minimum co-efficient of friction. The latch monitor arm is advantageously die cast or investment cast. The lip bracket is preferably die cast and/or investment cast. Advantageously, an aesthetically pleasing surface finish is provided. The face plate is constructed of stainless steel or other materials of sufficient strength to achieve an aesthetically pleasing surface finishing which can withstand the required abuse during use.

The strike is suitable for buildings requiring egress/ingress control such as commercial buildings, hospitals, warehouses, and educational facilities, as non-limiting examples. The latch and keeper monitor means are used for traffic intelligence, when the strike is connected to a building security system, for instance.

The invention claimed is:

1. An electric strike for a door, comprising:

a housing;

means for selecting a mode of the electric strike, wherein the means for selecting is operable from outside the housing, and the means for selecting is configured to allow the electric strike to operate in a first mode when the means for selecting is in a first selector position, and the means for selecting is configured to allow the electric strike to operate in a second mode when the means for selecting is in a second selector position; and a holder slidably arranged in the housing and comprising a slot defined therein, wherein the means for selecting is configured to selectively move the holder from a first holder position to a second holder position when the means for selecting moves from the first selector position to the second selector position, and wherein the means for selecting comprises a projection extending therefrom and fitting into the slot of the holder.

2. The electric strike of claim 1, wherein the first mode is a fail-secure mode, and the second mode is a fail-safe mode.

3. The electric strike of claim 1, wherein the means for selecting is configured to rotate about 180° when the means for selecting moves from the first selector position to the second selector position.

4. The electric strike of claim 1, wherein the means for selecting comprises a two-position mode selector.

5. The electric strike of claim 1, further comprising:

a keeper pivotally arranged in the housing;

a blocking element slidably arranged in the holder, wherein the blocking element is configured to selectively prevent a rotation of the keeper and allow the rotation of the keeper; and an actuator configured to selectively move the blocking element, wherein when the holder is in the first holder position, the blocking member allows the rotation of the keeper when the actuator is energized and prevents the rotation of the keeper when the actuator is not energized, wherein when the holder is in the second holder position, the blocking member prevents the rotation of the keeper when the actuator is energized and allows the rotation of the keeper when the actuator is not energized.

6. The electric strike of claim 1, wherein the means for selecting further comprises a slotted head projecting through an aperture defined in the housing and accessible from outside the housing to be operable therefrom.

7. The electric strike of claim 6, wherein the means for selecting further comprises an annular member connecting the slotted head to the projection.

8. The electric strike of claim 7, wherein an axis of the annular member is eccentric relative to an axis of the slotted head.

9. The electric strike of claim 7, wherein the annular member is a disc.

10. The electric strike of claim 7, wherein the annular member is retained within a groove formed in a back surface of the holder.

11. The electric strike of claim 8, wherein an axis of the projection is coaxial with the axis of the annular member.

12. The electric strike of claim 7, wherein the annular member is a cylinder.

13. The electric strike of claim 12, wherein the cylinder comprises a groove defined in an outer circumferential surface thereof.

14. The electric strike of claim 7, wherein an axis of the annular member is coaxial with an axis of the slotted head.

15. The electric strike of claim 14, wherein an axis of the projection is eccentric relative to the axes of the annular member and the slotted head.

16. An electric strike for a door, comprising:

means for allowing the electric strike to operate in a first mode when the means for allowing is in a first selector position and to operate in a second mode when the means for allowing is in a second selector position, wherein the means for allowing is operable from outside a housing of the electric strike; and a holder slidably arranged in the housing and comprising a slot defined therein, wherein the means for allowing is configured to selectively move the holder from a first holder position to a second holder position when the means for allowing moves from the first selector position to the second selector position, and wherein the means for selecting comprises a projection extending therefrom and fitting into the slot of the holder.

17. The electric strike of claim 16, wherein the first mode is a fail-secure mode, and the second mode is a fail-safe mode.

18. The electric strike of claim 16, wherein the means for allowing is configured to rotate about 180° when the means for allowing moves from the first selector position to the second selector position.

19. The electric strike of claim 16, wherein the means for allowing comprises a two-position mode selector.

20. The electric strike of claim 16, further comprising:

a keeper pivotally arranged in the housing;

a blocking element slidably arranged in the holder, wherein the blocking element is configured to selectively prevent a rotation of the keeper and allow the rotation of the keeper; and an actuator configured to selectively move the blocking element, wherein when the holder is in the first holder position, the blocking member allows the rotation of the keeper when the actuator is energized and prevents the rotation of the keeper when the actuator is not energized, wherein when the holder is in the second holder position, the blocking member prevents the rotation of the keeper when the actuator is energized and allows the rotation of the keeper when the actuator is not energized.

21. The electric strike of claim 16, wherein the means for selecting further comprises a slotted head projecting through an aperture defined in the housing and accessible from outside the housing to be operable therefrom.

22. The electric strike of claim 21, wherein the means for selecting further comprises an annular member connecting the slotted head to the projection.

23. The electric strike of claim 22, wherein an axis of the annular member is eccentric relative to an axis of the slotted head.

24. The electric strike of claim 22, wherein the annular member is a disc.

25. The electric strike of claim 22, wherein the annular member is retained within a groove formed in a back surface of the holder.

26. The electric strike of claim 23, wherein an axis of the projection is coaxial with the axis of the annular member.

27. The electric strike of claim 22, wherein the annular member is a cylinder.

28. The electric strike of claim 27, wherein the cylinder comprises a groove defined in an outer circumferential surface thereof.

29. The electric strike of claim 22, wherein an axis of the annular member is coaxial with an axis of the slotted head.

30. The electric strike of claim 29, wherein an axis of the projection is eccentric relative to the axes of the annular member and the slotted head.

* * * * *